US007757805B2

(12) United States Patent
Wakuta et al.

(10) Patent No.: US 7,757,805 B2
(45) Date of Patent: Jul. 20, 2010

(54) WORKING VEHICLE

(75) Inventors: Kensaku Wakuta, Osaka (JP); Kazuhiko Miyamoto, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 155 days.

(21) Appl. No.: 12/214,956

(22) Filed: Jun. 24, 2008

(65) Prior Publication Data

US 2009/0313861 A1 Dec. 24, 2009

(51) Int. Cl.
*B66C 23/00* (2006.01)

(52) U.S. Cl. ..... 180/312; 180/346; 180/374; 180/376; 180/378; 280/781; 414/686

(58) Field of Classification Search ..... 180/311, 180/312, 46, 369, 374–378; 414/686; *B62D 49/00*
See application file for complete search history.

(56) References Cited

U.S. PATENT DOCUMENTS

| | | | | |
|---|---|---|---|---|
| 7,300,241 | B2 * | 11/2007 | Fukudome et al. | 414/686 |
| 2003/0010563 | A1 * | 1/2003 | Osuga et al. | 180/311 |
| 2004/0145172 | A1 * | 7/2004 | Aoki et al. | 280/781 |
| 2004/0265109 | A1 * | 12/2004 | Uchijima et al. | 414/686 |
| 2005/0210716 | A1 * | 9/2005 | Miyazaki | 37/443 |
| 2006/0245900 | A1 * | 11/2006 | Nishi et al. | 414/686 |
| 2006/0254415 | A1 * | 11/2006 | Miyazaki et al. | 91/508 |
| 2007/0003401 | A1 * | 1/2007 | Tanaka et al. | 414/685 |
| 2009/0230731 | A1 * | 9/2009 | Sakamoto et al. | 296/204 |

FOREIGN PATENT DOCUMENTS

| | | |
|---|---|---|
| JP | 6-032188 | 2/1994 |
| JP | 2003-026056 | 1/2003 |
| JP | 2003-166260 | 6/2003 |

* cited by examiner

*Primary Examiner*—Ruth Ilan
(74) *Attorney, Agent, or Firm*—Jordan and Hamburg LLP

(57) ABSTRACT

In a working vehicle in which a backhoe support frame for reinforcing is provided in a rear end portion of a vehicle body frame, and a transmission case is mounted on a rear portion of the vehicle body frame so as to be close to the backhoe support frame, each of support brackets provided in an outer side surface of a rear portion of each of main frames constructing the vehicle body frame so as to protrude outward is connected to a protruding end portion protruding to rightwardly and leftwardly relative to each of lower brace members in a reinforcing plate supporting a lower surface of the transmission case in a state in which a rear axle case protruding outward from the right and left side surfaces of the transmission case is sandwiched from upper and lower sides, in order to dissolve a risk that a load generated at a time of traveling in a backhoe installed state or at a time of an excavating work by the backhoe is propagated to the transmission case.

4 Claims, 13 Drawing Sheets

WORKING VEHICLE

BACKGROUND OF THE INVENTION

1. Field of the Invention

The present invention relates to a working vehicle, for example, a tractor front loader backhoe (hereinafter, refer to as TLB).

2. Description of Background Art

Conventionally, in the TLB serving as the working vehicle, since various loads such as a compression, a tension, a deflection, a bending and the like are applied to a vehicle body frame constructing a traveling vehicle body in a complex manner at a time of traveling in a state in which a backhoe is installed to a rear portion of the traveling vehicle body or at a time of an excavating work by the backhoe, there is employed such a structure that a backhoe support frame for reinforcing is provided in a rear end portion of the vehicle body frame and the backhoe is installed to the backhoe support frame, for example, as described in Japanese Unexamined Patent Publication No. 6-32188.

In accordance with this structure, the backhoe support frame serves as a strength member complementing a rigidity of the vehicle body frame, and the load generated at a time of traveling in the backhoe installed state or at a time of the excavating work by the backhoe is dispersed to the vehicle body frame and the backhoe support frame. Accordingly, it is possible to improve a support strength as a whole of the traveling vehicle body.

In this case, a cast-iron heavy load such as an engine and a transmission case is coupled and fixed to the vehicle body frame mentioned above. The engine is arranged in a front portion of the vehicle body frame, and the transmission case is arranged in a rear portion of the vehicle body frame. Accordingly, the transmission case comes close to the backhoe support frame for reinforcing. Therefore, in the conventional structure mentioned above, since there is a risk that the load generated at a time of traveling in the backhoe installed state or at a time of the excavating work by the backhoe is propagated to the transmission case, it is necessary to thicken the transmission case for securing a strength. As a result, there is a problem that the mission case is made large in size and heavy and the vehicle body frame itself supporting the transmission case is made large in size and heavy, so that a manufacturing cost is increased.

SUMMARY OF THE INVENTION

The present invention is made by taking the actual condition mentioned above into consideration. In accordance with a first aspect of the present invention, there is provided a working vehicle comprising: a vehicle body frame including a pair of right and left main frames which extend longitudinally and a plurality of horizontal frames which extend laterally in a ladder shape; a backhoe support frame provided in a rear end portion of the vehicle body frame; a pair of right and left upper brace members connecting an upper portion side of each of the main frames and an upper portion side of the backhoe support frame; a pair of right and left lower brace members connecting a lower portion side of each of the main frames and a lower portion side of the backhoe support frame; a pair of right and left support brackets provided in an outer side surface of a rear portion of each of the main frames so as to protrude outward; and a reinforcing plate attached to both of the lower brace members and supporting a lower surface of a transmission case mounted on a rear portion side of the vehicle body frame.

Further, each of the support brackets, and the protruding end portion protruding to the rightwardly and leftwardly relative to each of the lower brace members in the reinforcing plate are so coupled that a rear axle case protruding outward from the right and left outer side surfaces of the transmission case is disposed between the support bracket and protruding end portion from upper and lower sides.

In accordance with the structure mentioned above, since the reinforcing plate and both of the lower brace members serve as a strength member supplementing the rigidity of the vehicle body frame, the load generated at a time of traveling in the backhoe installed state or at a time of the excavating work by the backhoe is dispersed to the reinforcing plate and both of the lower brace members, in addition to the vehicle body frame and the backhoe support frame.

Accordingly, since it is possible to inhibit the load from being propagated to each of the cases as well as it is possible to improve the support strength serving as a whole of the traveling vehicle body with respect to the transmission case and the rear axle case, it is not necessary to thicken each of the cases themselves, and it is possible to avoid the cases from being made large in size. As a result, it is possible to achieve an effect of contributing to a suppression of a manufacturing cost.

In accordance with a second aspect of the present invention, there is provided a working vehicle comprising: an engine mounted to a front portion of a vehicle body frame constructing a traveling vehicle body; a backhoe installed to a backhoe support frame provided in a rear end portion of the vehicle body frame; a transmission case changing gear a power applied from the engine; a seating detecting means detecting a seating of an operator on a control seat provided on the traveling vehicle body; an engine stop mechanism stopping the engine on the basis of a detected information of the seating detecting means; and a seating direction detecting means detecting a direction of the control seat.

Further, the engine stop mechanism is structured such as to be out of commission regardless of a state of the seating detecting means, at a time of detecting by the seating direction detecting means that the control seat is backward directed.

In accordance with the structure mentioned above, as far as the control seat is backward directed, the engine stop mechanism becomes out of commission regardless of whether or not the operator is seated, and the engine maintains a drive state. Accordingly, in spite of the working vehicle having the seating detecting means and taking a safety into consideration, there can be achieved an effect that it is possible to smoothly start the engine at a time of the excavating work by the backhoe which is carried out in a state of directing the control seat backward.

DETAILED DESCRIPTION OF THE INVENTION

Figure 1:
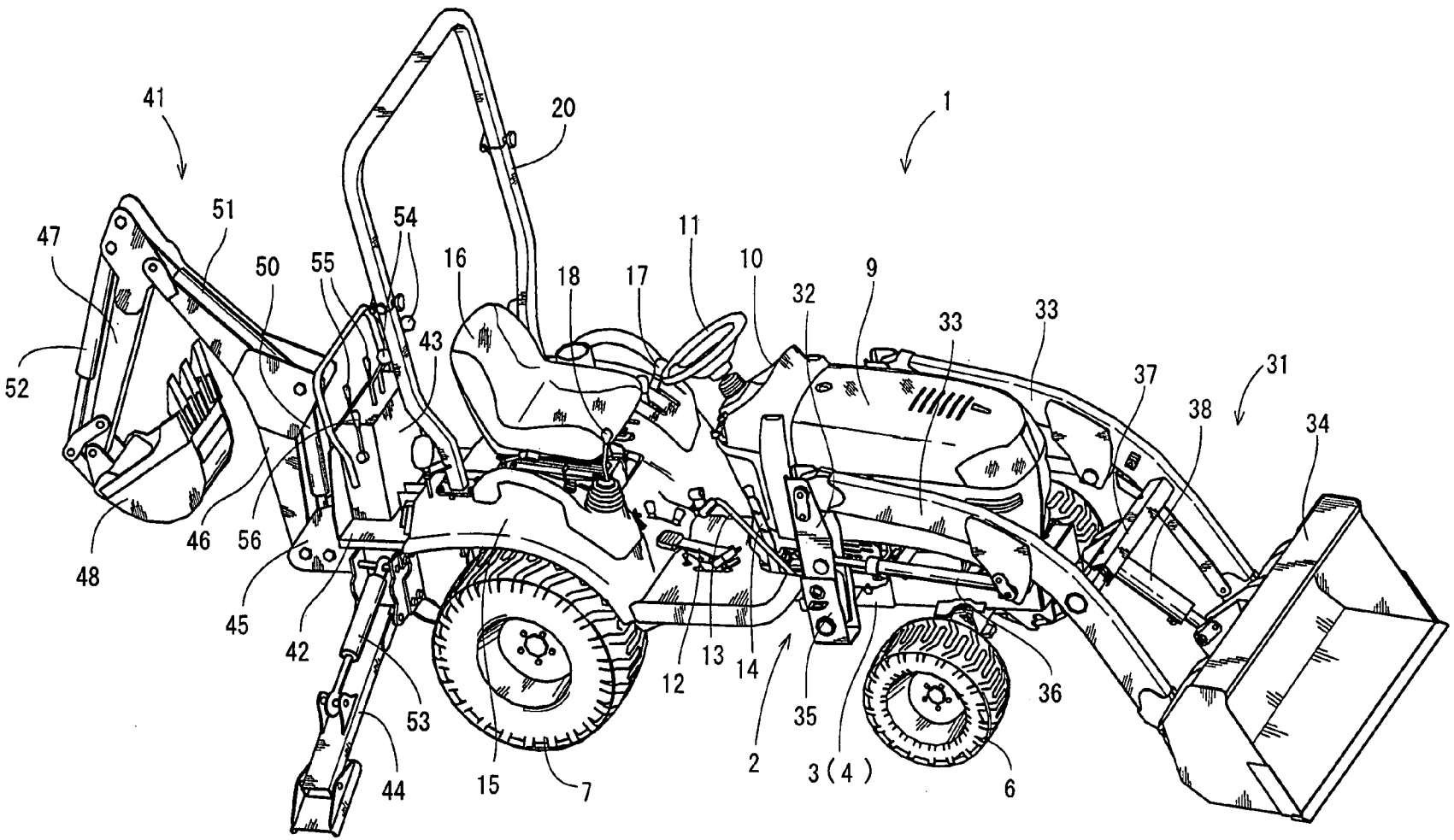
FIG. 1 is a perspective view of a whole of a TLB.
Figure 2:
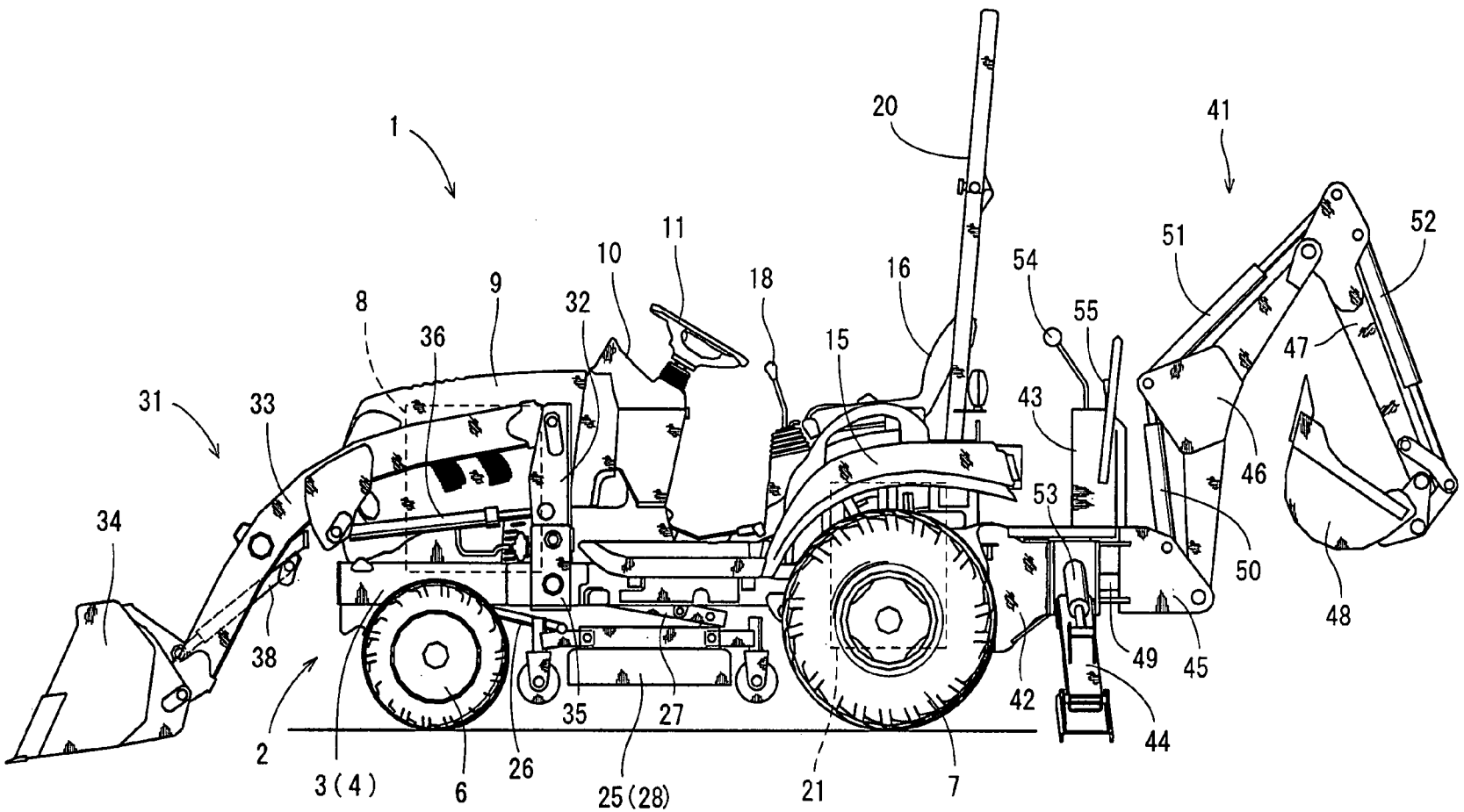
FIG. 2 is a left side elevational view of the TLB.
Figure 3:
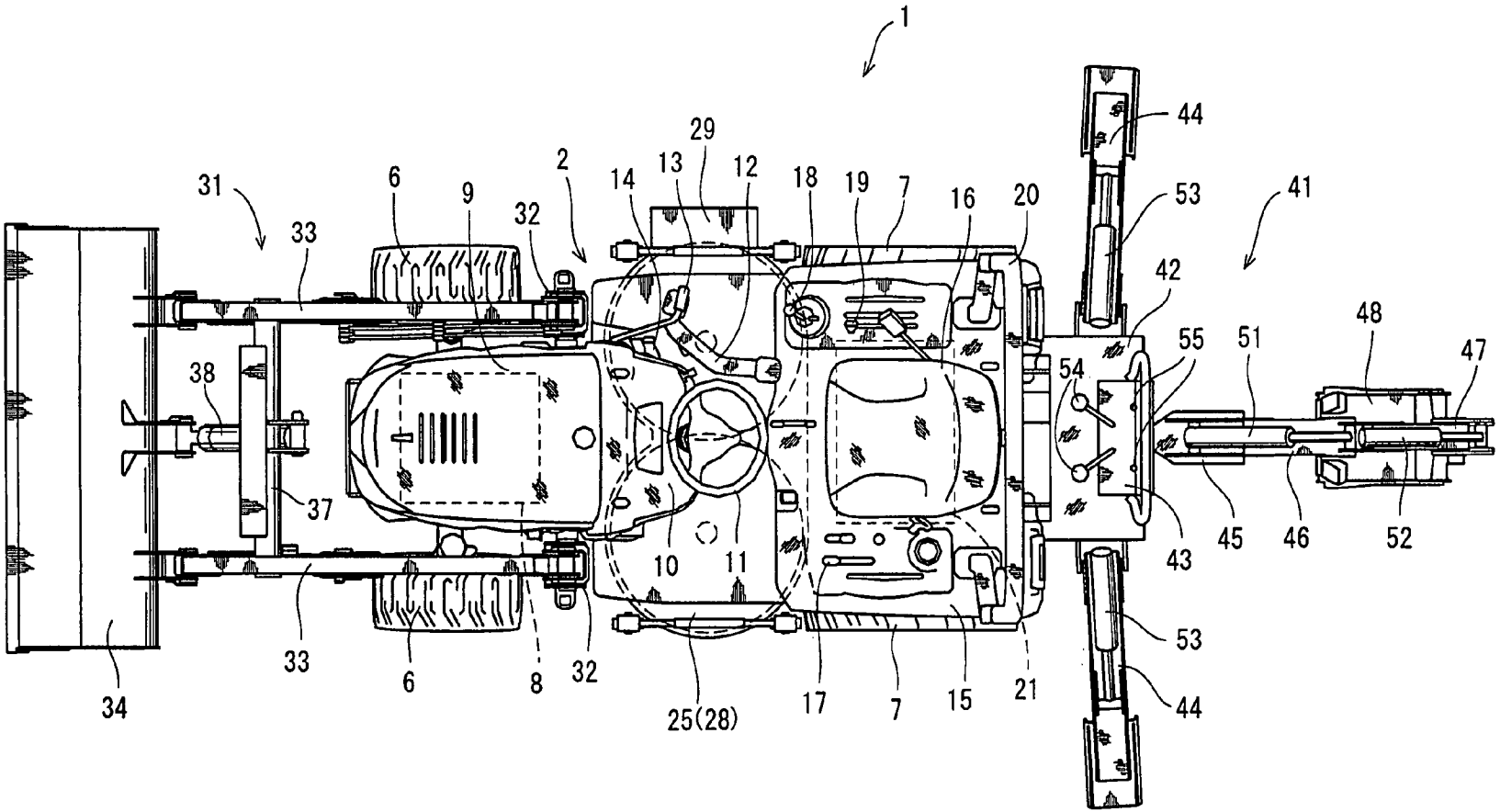
FIG. 3 is a plan view of the TLB.
Figure 4:
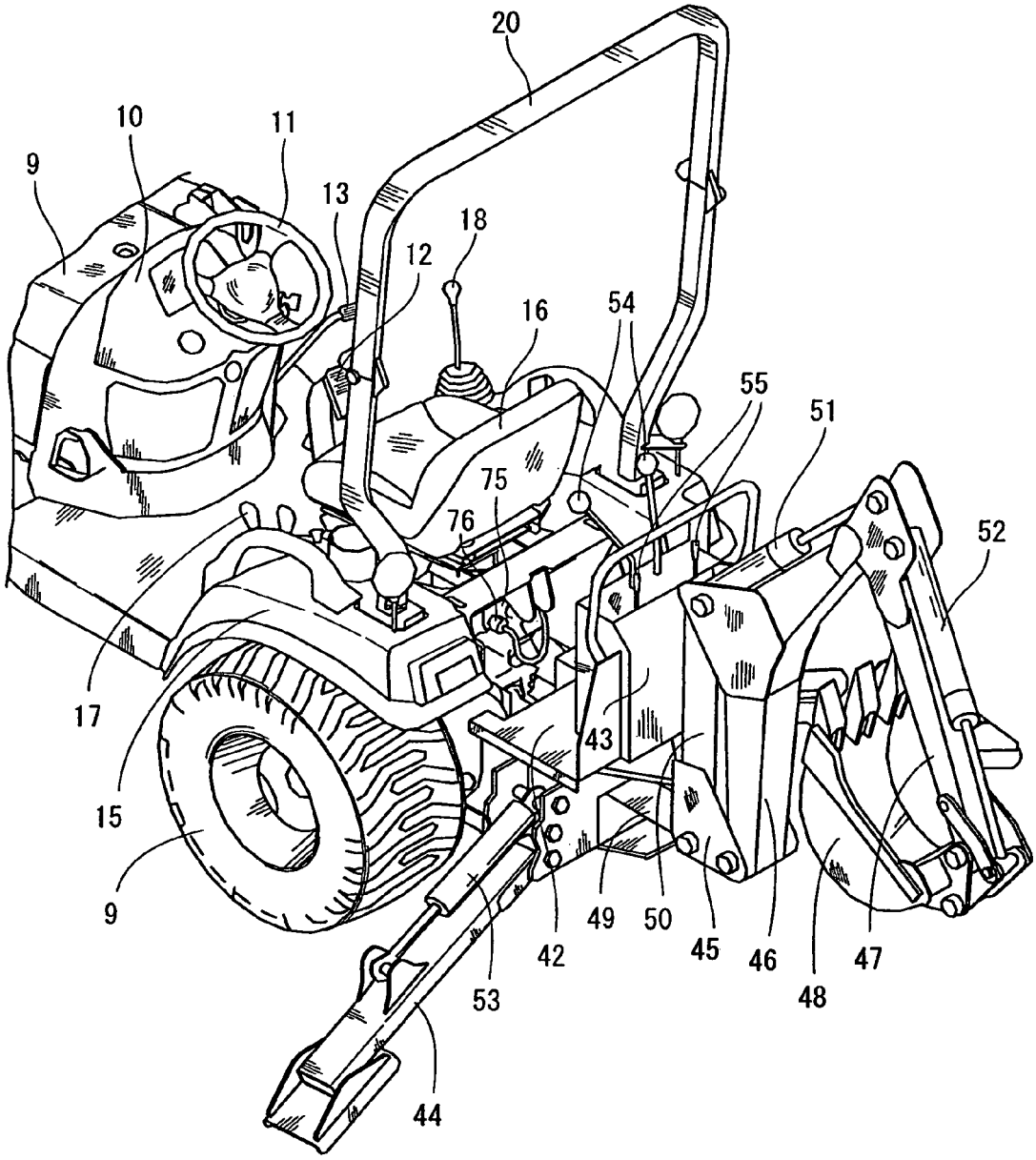
FIG. 4 is an enlarged perspective view of a rear portion in the case of viewing the TLB from a left oblique rear side.
Figure 5:
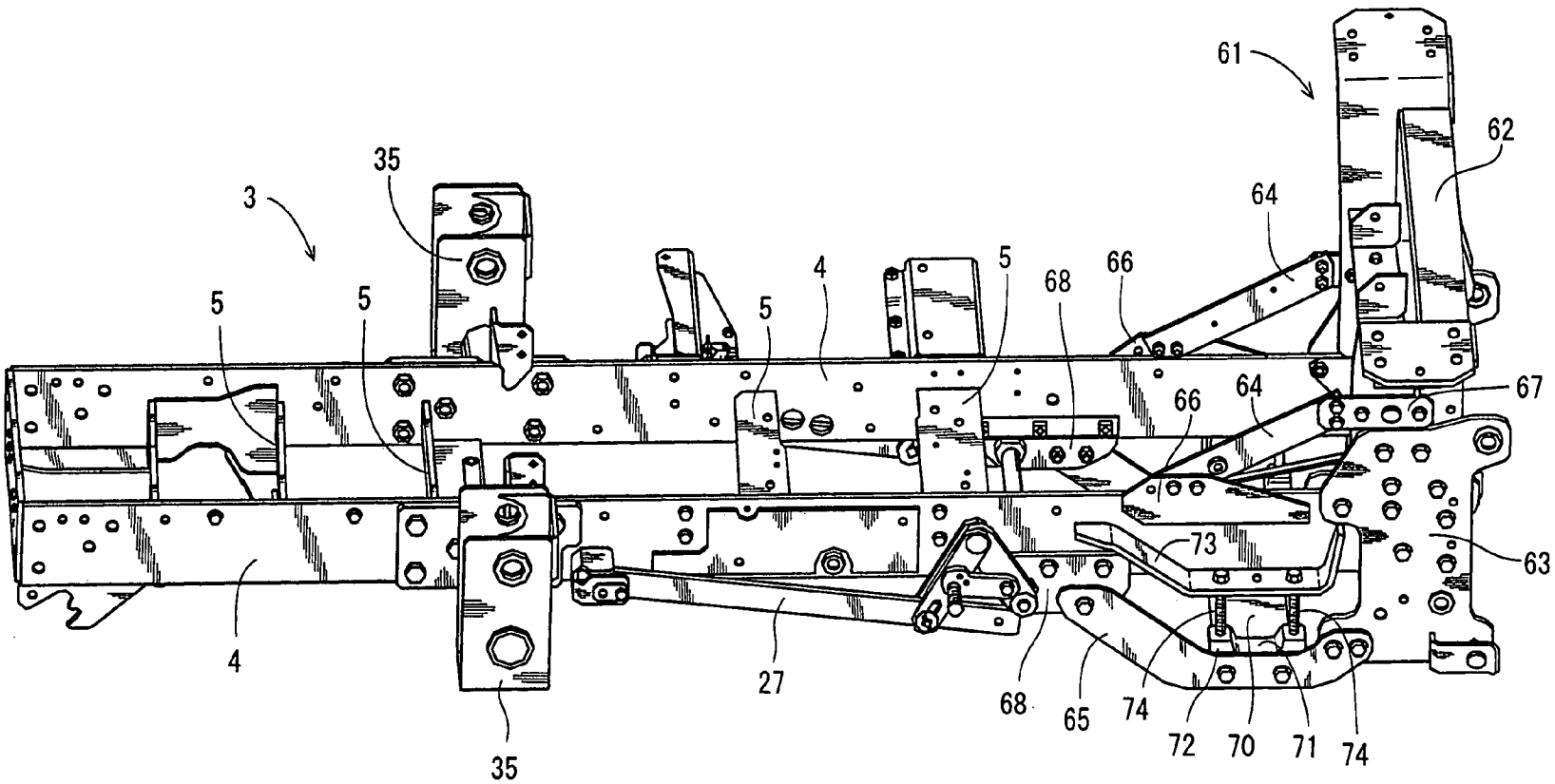
FIG. 5 is a perspective view in the case of viewing a vehicle body frame from a left oblique upper side.
Figure 6:
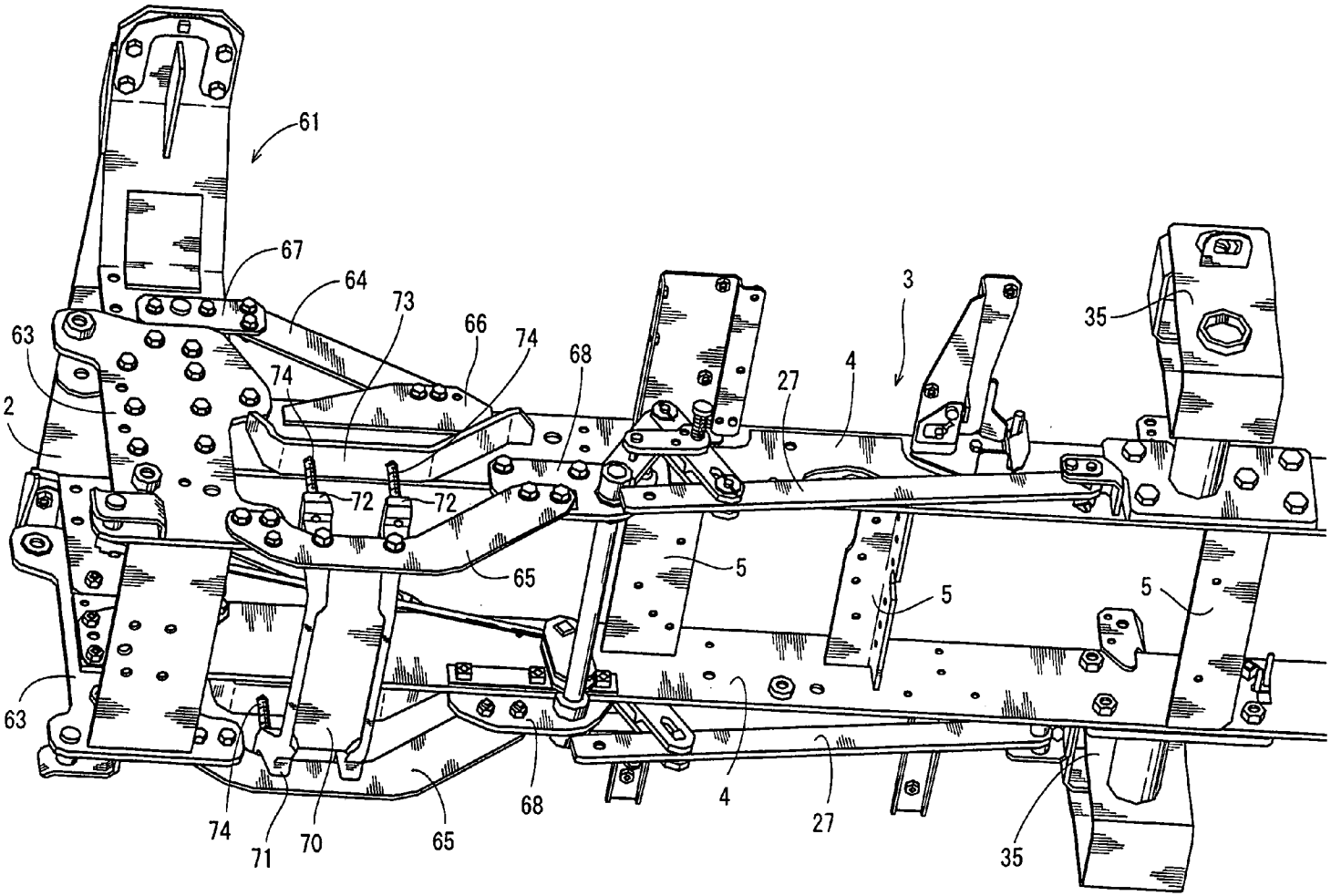
FIG. 6 is a perspective view in the case of viewing the vehicle body frame from a right oblique lower side.
Figure 7:
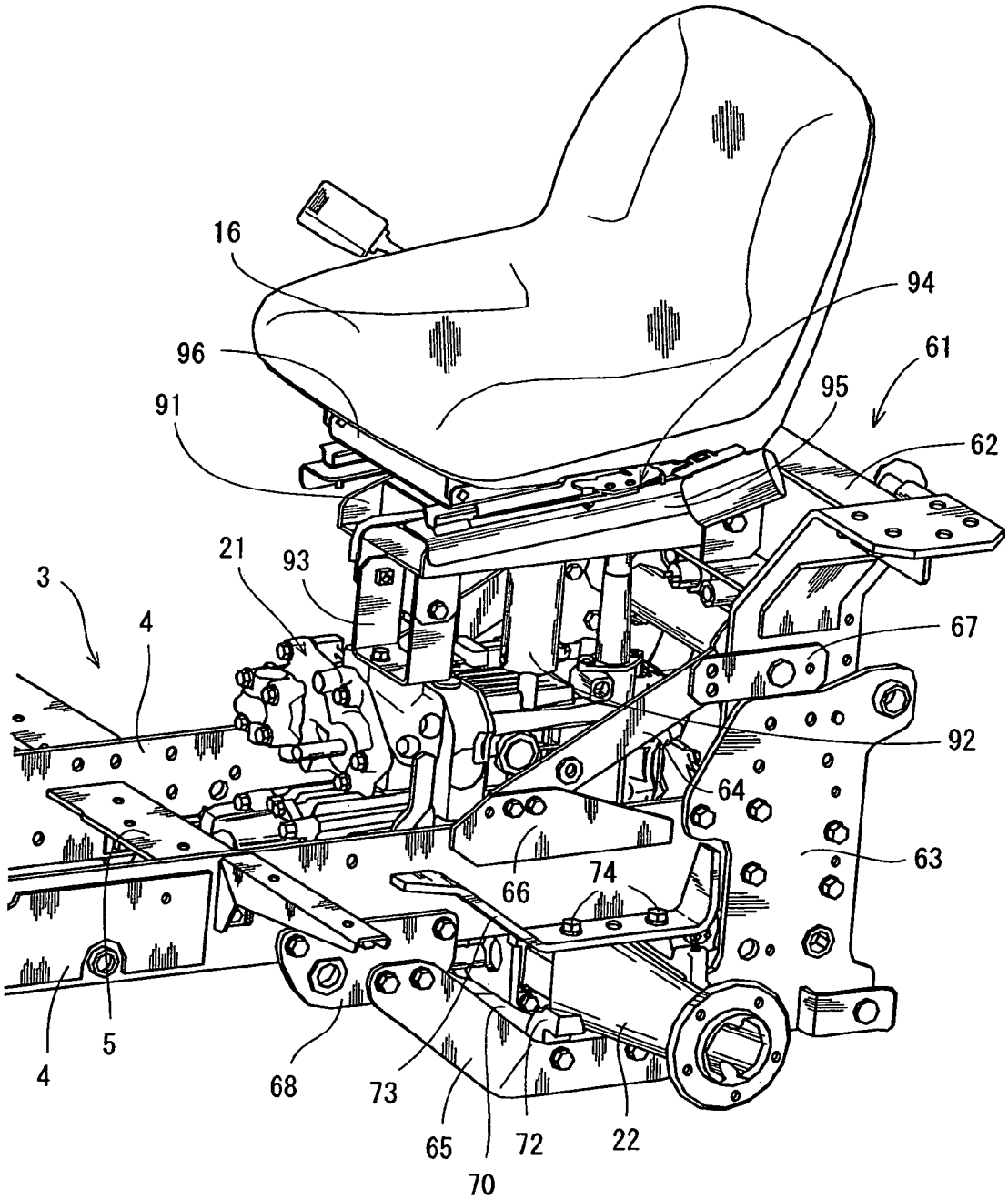
FIG. 7 is an enlarged perspective view in the case of viewing the vehicle body frame with a transmission case from a left oblique upper side.
Figure 8:
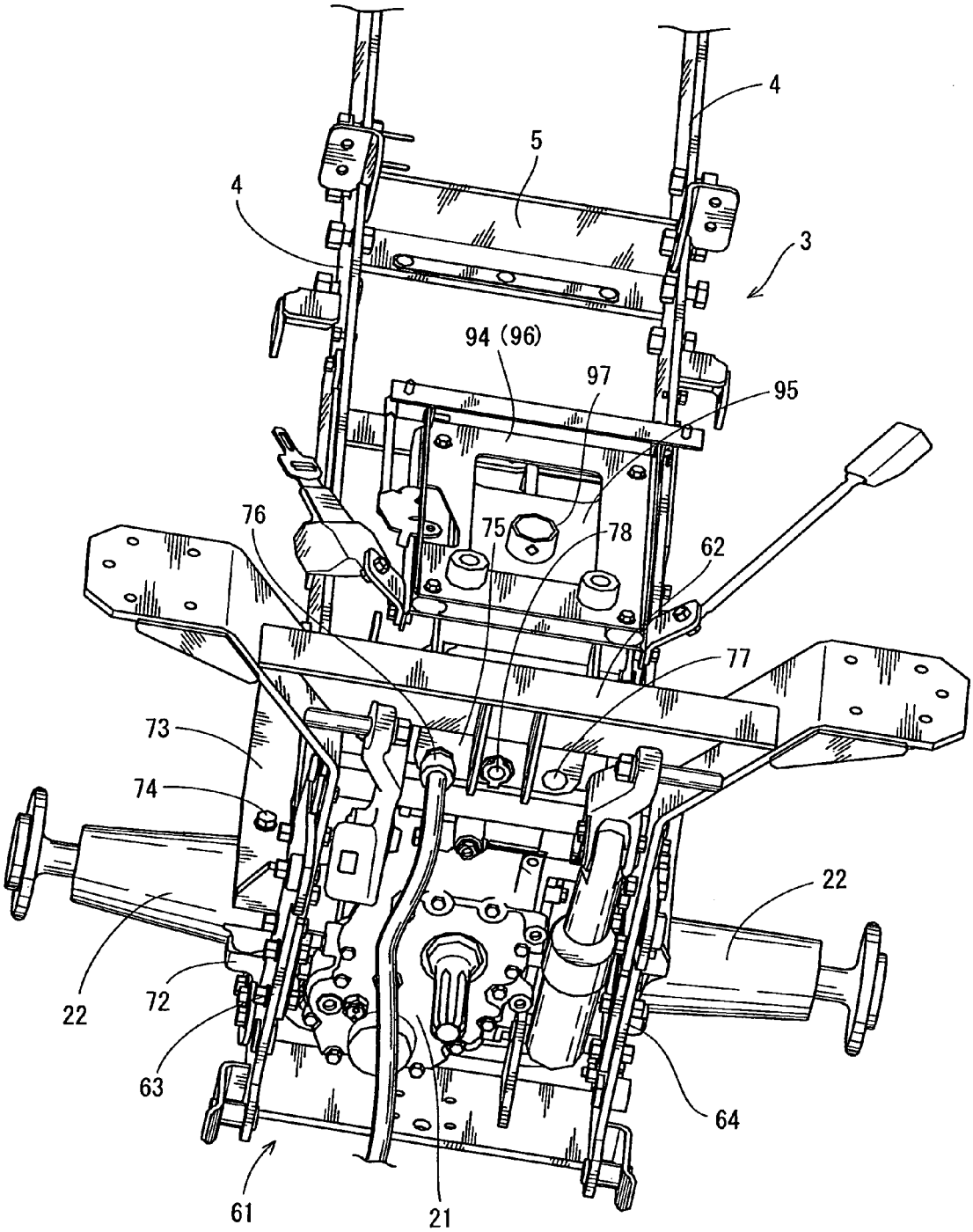
FIG. 8 is a perspective view in the case of viewing the vehicle body frame with the transmission case from a rear side.
Figure 9:
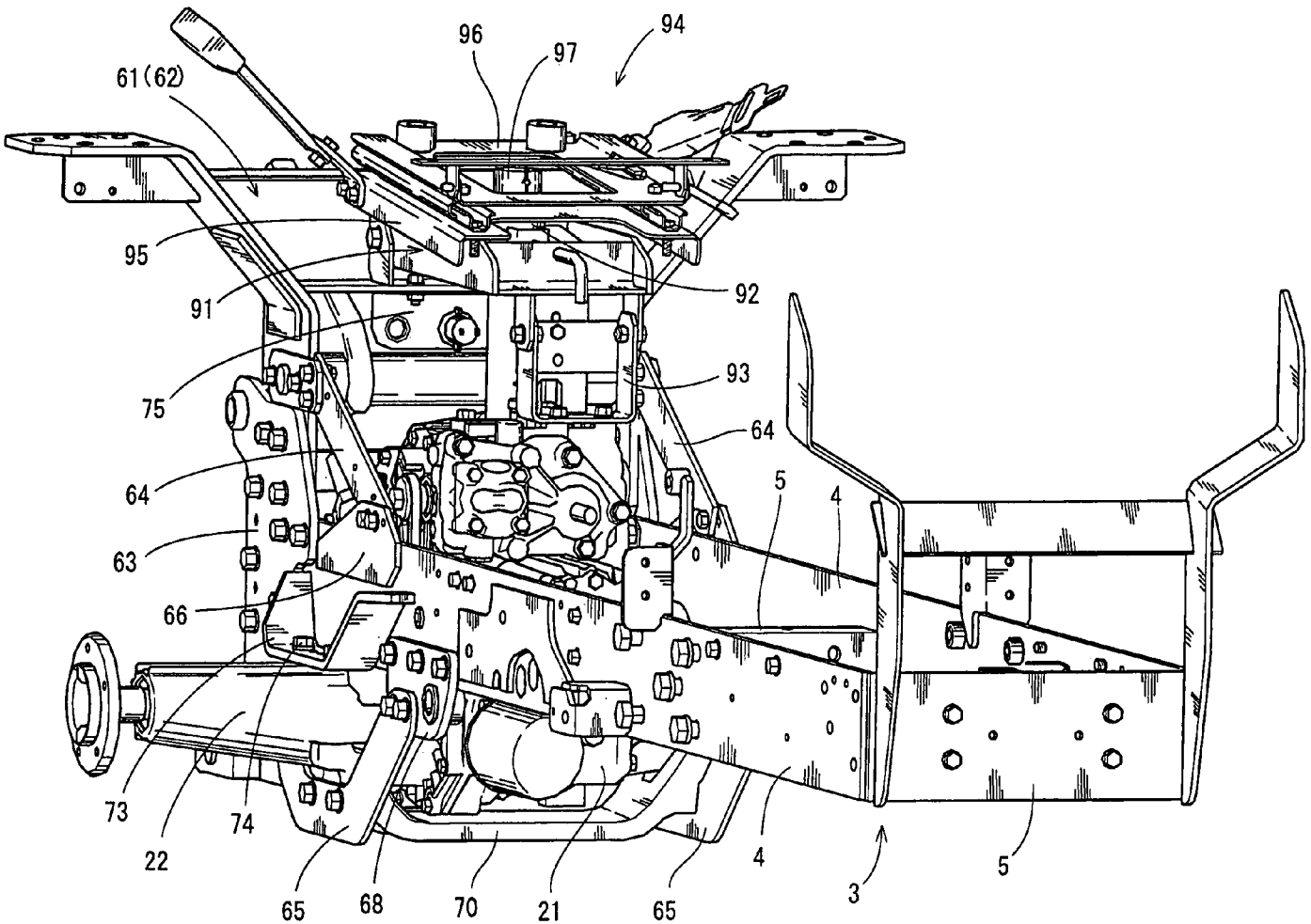
FIG. 9 is a perspective view in the case of viewing the vehicle body frame with the transmission case from a right oblique front side.
Figure 10:
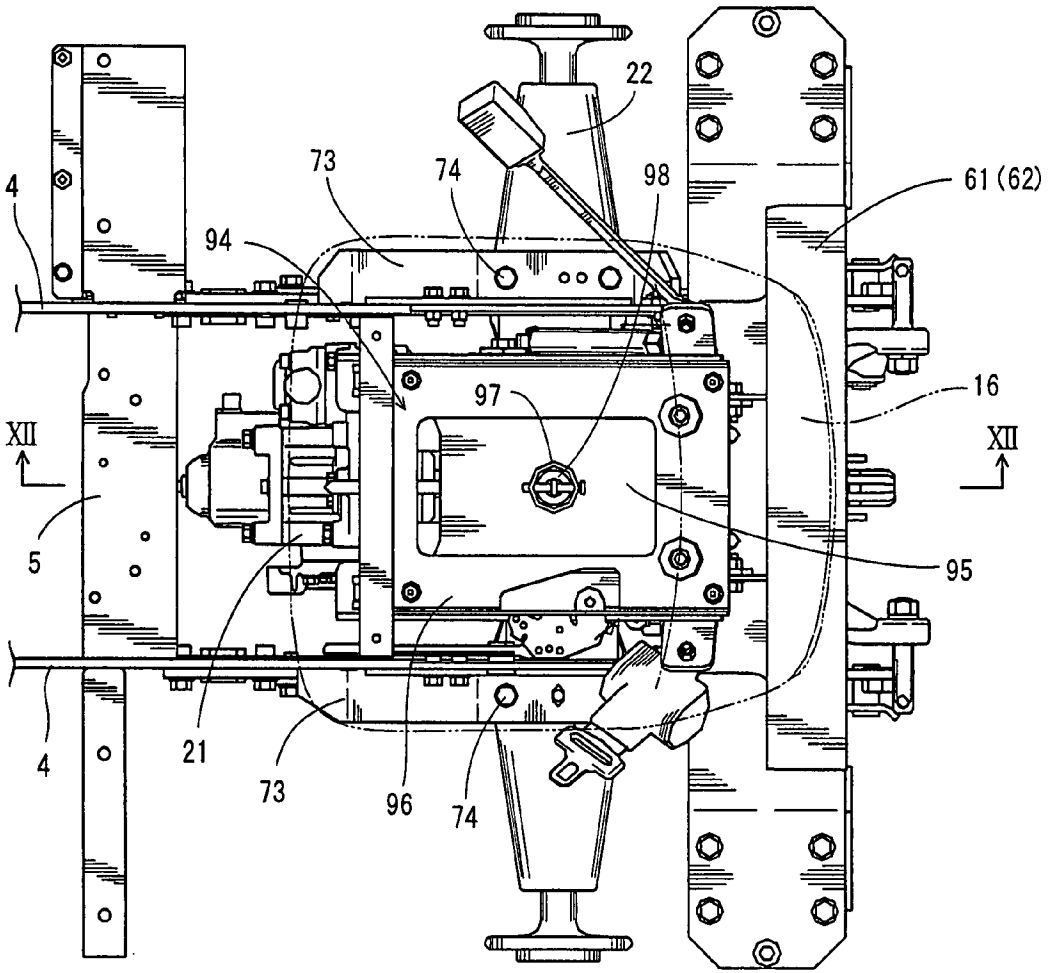
FIG. 10 is an enlarged plan view of a rear portion of the vehicle body frame at a time when a control seat is directed forward.
Figure 11:
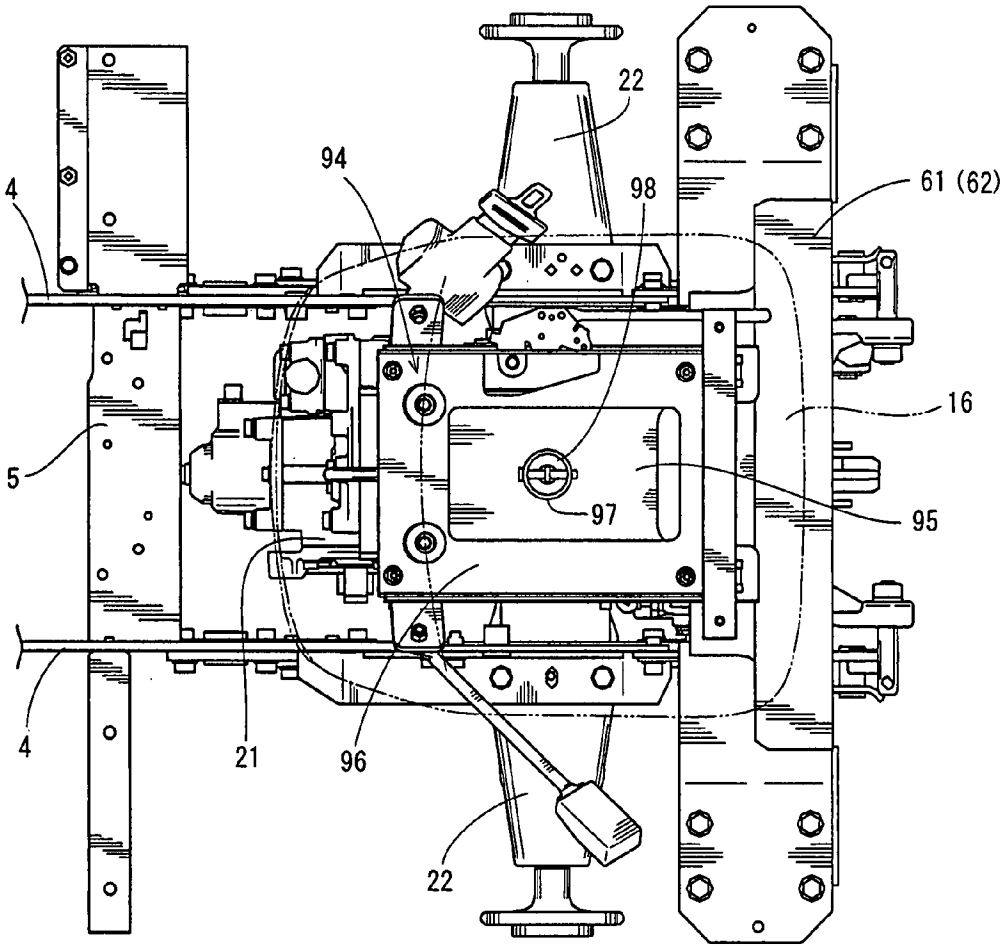
FIG. 11 is an enlarged plan view of the rear portion of the vehicle body frame at a time when the control seat is directed backward.
Figure 12:
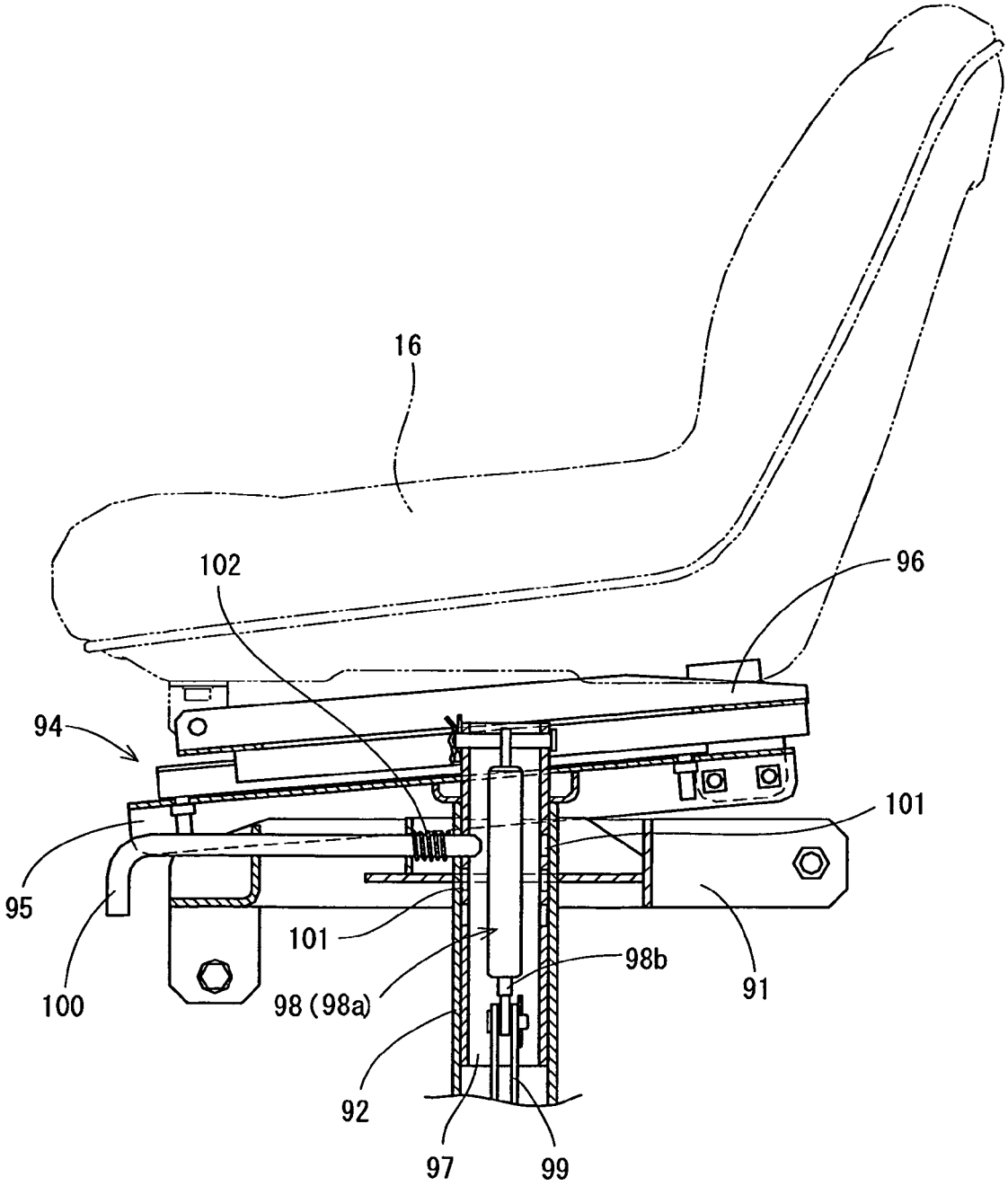
FIG. 12 is a side elevational cross sectional view as seen from a line XII-XII in FIG. 10.
Figure 13:
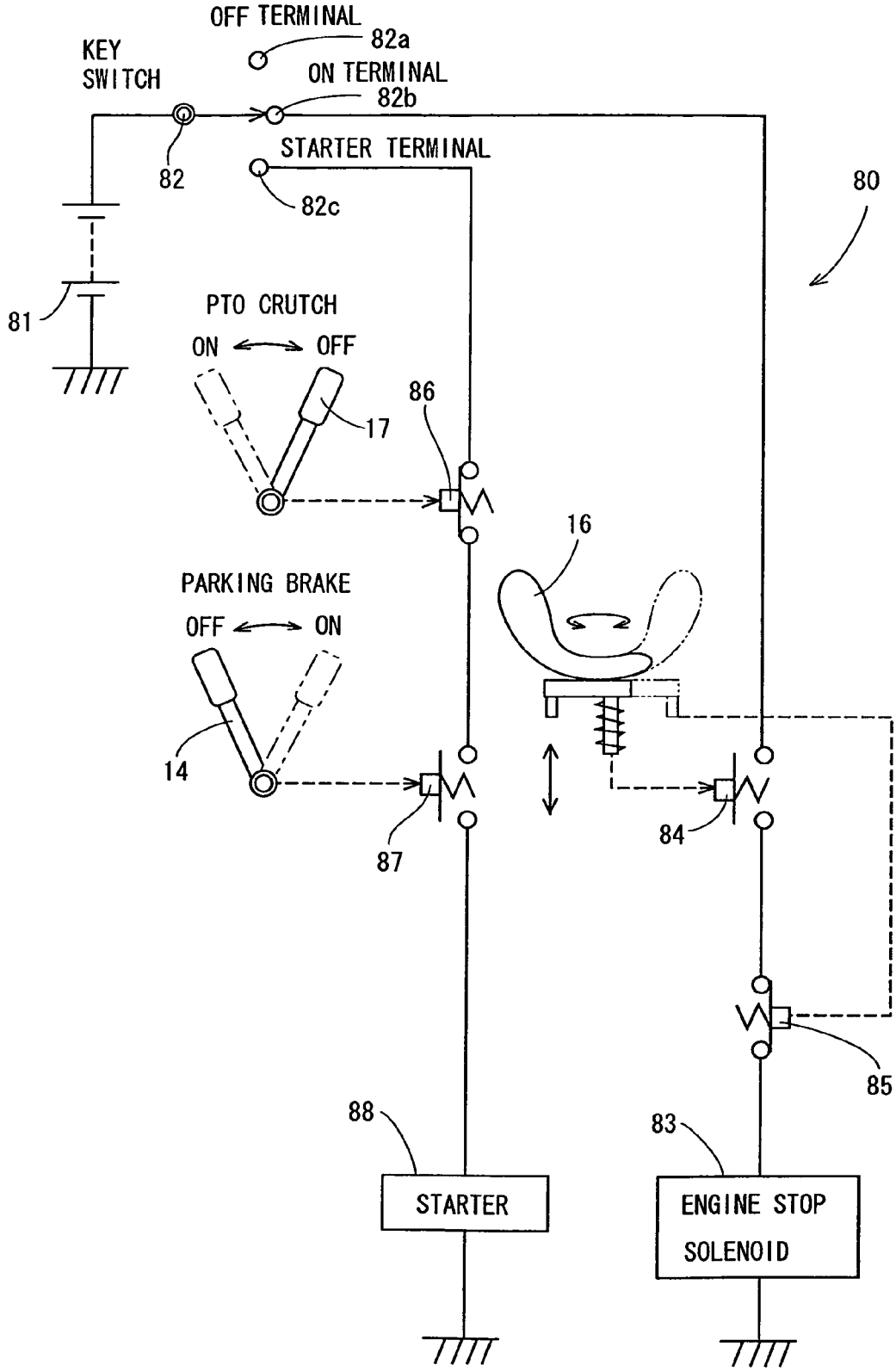
FIG. 13 is an electric circuit diagram of a safety mechanism.

A description will be given of an embodiment in which the present invention is applied to a TLB serving as a working vehicle with reference to the accompanying drawings (FIGS. 1 to 13). FIG. 1 is a perspective view of a whole of the TLB, FIG. 2 is a left side elevational view of the TLB, FIG. 3 is a plan view of the TLB, FIG. 4 is an enlarged perspective view of a rear portion in the case of viewing the TLB from a left oblique rear side, FIG. 5 is a perspective view in the case of viewing a vehicle body frame from a left oblique upper side, FIG. 6 is a perspective view in the case of viewing the vehicle body frame from a right oblique lower side, FIG. 7 is an enlarged perspective view in the case of viewing the vehicle body frame with a transmission case from a left oblique upper side, FIG. 8 is a perspective view in the case of viewing the vehicle body frame with the transmission case from a rear side, FIG. 9 is a perspective view in the case of viewing the vehicle body frame with the transmission case from a right oblique front side, FIG. 10 is an enlarged plan view of a rear portion of the vehicle body frame at a time when a control seat is directed forward, FIG. 11 is an enlarged plan view of the rear portion of the vehicle body frame at a time when the control seat is directed backward, FIG. 12 is a side elevational cross sectional view as seen from a line XII-XII in FIG. 10, and FIG. 13 is an electric circuit diagram of a safety mechanism.

In the following description, a left side in the direction of a forward moving direction of the TLB 1 is called simply as a left side, and a right side in the direction of the forward moving direction is called simply as a right side in the same manner. Further, FIG. 1 omits an illustration of a mower device.

(1) Outline of TLB

First, a description will be given of a whole outline of the TLB 1 mainly with reference to FIGS. 1 to 4.

A traveling vehicle body 2 of the TLB 1 is provided with a vehicle body frame 3 (see FIGS. 5 and 6) including a pair of right and left main frames 4 which extend longitudinally, and a plurality of horizontal frames 5 which extend laterally, in a ladder shape. The vehicle body frame 3 is supported by right and left front wheels 6 and right and left rear wheels 7 serving as a traveling portion and mounted on front and rear sides in both right and left sides. An engine 8 serving as a power source is mounted to a front portion of the vehicle body frame 3. The TLB 1 is structured such as to travel forward and backward by driving the front wheels 6 and the rear wheels 7 by the engine 8. The engine 8 is covered by a hood 9.

A control column portion 10 having a control handle 11 is mounted on a rear portion of an upper surface of the hood 9. In this case, if the control handle 11 is rotationally operated, the structure is made such that a steering angle of both the right and left front wheels 6 is changed in correspondence to an operating amount (a rotating amount). In a lower side of the control column portion 10, there are arranged a shift pedal 12 for regulating a forward and backward moving speed of the traveling vehicle 2, a brake lever 13 for operating so as to brake both the right and left rear wheels 7, and a parking brake lever 14 serving as a parking brake operating means carrying out an operation for retaining a braked state of both the right and left rear wheels 7.

A control seat 16 structured such as to be capable of changing the direction forward and backward is provided on a rear cowl 15 covering a rear portion of the upper surface of the traveling vehicle body 2. In a left side of the control seat 16, there is arranged a PTO lever 17 or the like serving as a PTO operating means operating so as to maintain and intermit a power transmission from a transmission case 21 mentioned below to a mower device 25 mentioned below. In a right side of the control seat 16, there are arranged a loader lever 18 for operating a front loader 31 mentioned below, an accelerator lever 19 for increasing and decreasing a rotating speed of the engine 8, and the like. A rear side of the control seat 16 is provided with a lops frame 20 for protecting an operator at a time when the traveling vehicle body 2 is inverted.

Although the details will be mentioned later, the transmission case 21 for appropriately shifting the power from the engine 5 so as to transmit the power to the front wheels 6 and the rear wheels 7 is mounted on a rear portion of the vehicle body frame 3. A rear axle case 22 is installed to both right and left side portions of the transmission case 21 in such a manner as to protrude to right and left outer sides. The right and left rear wheels 7 are rotatably attached to right and left leading end sides in the rear axle case 22. In this embodiment, the control seat 16 is positioned in an upper side of the transmission case 21.

The mower device 25 for mowing a lawn is installed between the front wheels 6 and the rear wheels 7 in a lower portion of the traveling vehicle body 2 so as to be movable up and down and rotatable via a pair of front and rear link levers 26 and 27 (see FIGS. 2, 5 and 6). The mower device 25 is provided with a pair of horizontally rotatable rotary mowing blades (not shown) within a mower case 28 formed as a downward open bowl shape. A discharge duct 29 for discharging the mowed lawn is formed in a horizontal one side portion of the mower case 28 so as to be open outward. The mowed lawn mowed by the rotary mowing blades is discharged to a horizontal side of the traveling vehicle body 2 from the discharge duct 29 by utilizing a carrier wind generated by the rotation of the rotary mowing blade.

The front loader 31 is provided in a front portion of the traveling vehicle body 2. The front loader 31 has loader posts 32 mounted on both right and left sides while disposing the hood 9 therebetween, a pair of right and left lift arms 33 coupled to upper ends of the respective loader posts 32 so as to be capable of oscillating up and down, and a bucket 34 coupled to leading end portions of both the lift arms 33 so as to be capable of oscillating up and down.

Each of the right and left loader posts 32 is provided in a rising manner in a post support member 35 protruded outward right and left from a longitudinal middle portion of each of the main frames 4 in the vehicle body frame 3. A lift cylinder 36 for oscillating the lift arm 33 up and down is provided between each of the loader posts 32 and the corresponding lift arm 33. A bucket cylinder 38 for oscillating the bucket 34 up and down is provided between a horizontal frame 37 connecting between the longitudinal middle portions of both the lift arms 33 and the bucket 34.

In this case, both the lift arms 33 and the bucket 34 are oscillated up and down by operating so as to expand and contract both the lift cylinders 36 and the bucket cylinder 38 in accordance with an operation of the loader lever 18 provided in a right side of the control seat 16. The operation of the loader lever 18 can be carried out in a state of seating on the forward-looking control seat 16.

A backhoe 41 is provided in a rear portion of the traveling vehicle body 2. The backhoe 41 has a base plate 42 including a control portion 43, an outrigger 44, and the like, a swing bracket 45 coupled to the base plate 42 so as to freely oscillate laterally, a boom 46 coupled to the swing bracket 45 so as to freely oscillate up and down, an arm 47 coupled to a leading end portion of the boom 46 so as to freely oscillate longitudinally, and a bucket 48 coupled to a leading end portion of the arm 47 so as to freely scoop and oscillate.

The base plate 42 is detachably installed to a backhoe support frame 61 (see FIGS. 5 and 6) provided in a rear end portion of the vehicle body frame 3. A swing cylinder 49 for oscillating the swing bracket 45 laterally is provided between the base plate 42 and the swing bracket 45. A boom cylinder 50 for oscillating the boom 46 up and down is provided between the swing bracket 45 and the longitudinal middle portion of the boom 46. An arm cylinder 51 for oscillating the arm 47 longitudinally is provided between the longitudinal middle portion of the boom 46 and a base end portion of the arm 47. A bucket cylinder 52 for scooping and oscillating the bucket 48 is provided between the base end portion of the arm 47 and the bucket 48.

The outrigger 44 provided in both the right and left side portions of the base plate 42 so as to be rotatable up and down is a structure for positioning and fixing the traveling vehicle body 2 at a time of an excavating work by the backhoe 41. A hydraulic cylinder 53 for rotating the outrigger 44 up and down is provided between the base plate 42 and the longitudinal middle portion of each of the outriggers 44.

The control portion 42 set in an upper surface of the base plate is provided with a pair of right and left backhoe levers 54 for operating the backhoe 41 so as to be activated up and down and right and left, a pair of right and left outrigger levers 55 for operating each of the outriggers 44 so as to rotate up and down, and a base plate side accelerator lever 56 for accelerating and decelerating the rotating speed of the engine 8 at a time of the excavating work by the hack hoe 41.

In this case, the swing bracket 45, the boom 46, the arm 47 and the bucket 48 are oscillated by actuating the swing cylinder 49, the boom cylinder 50, the arm cylinder 51, and the bucket cylinder 52 so as to expand and contract in accordance with the operation of the backhoe lever 54. Further, each of the right and left outriggers 44 is rotated up and down by actuating the corresponding hydraulic cylinder 53 so as to expand and contract, in accordance with the operation of each of the outrigger levers 55.

The operation of the various levers 54 to 56 provided in the control portion 42 is carried out in a state of rotating the control seat 16 at 180 degree, and seating on the control seat 16 directed backward. In this case, the base plate side accelerator lever 56 is structured such as to function only at a time when the control seat 16 is directed backward. Further, the base plate side accelerator lever 56 may be provided in the traveling vehicle body 2 side (for example, at the lops frame 20 or the like).

(2) Attaching Structure of Transmission Case

Next, a description will be given of an attaching structure of the transmission case 21 mainly with reference to FIGS. 5 to 9.

As mentioned above, the vehicle body frame 3 is structured such that a pair of right and left main frames 4 which extend longitudinally and a plurality of horizontal frames 5 which extend laterally are coupled as a ladder shape. The rear end portion of the vehicle body frame 3 is provided with a backhoe support frame 61 to which the base plate 42 is installed. The backhoe support frame 61 in the embodiment is formed as a rectangular shape in a front view, and right and left side frame portions 63 of the backhoe support frame 61 are fastened by bolts to the rear end portion of the main frame 4 corresponding thereto.

The rear portion side of each of the main frames 4 and an upper portion side of the right and left side frame portions 63 in the backhoe support frame 61 are coupled by a long plate-shaped upper brace member 64. Further, the rear portion side of each of the main frames 4 and a lower portion side of the right and left side frame portion 63 in the backhoe support frame 61 are coupled by a curved plate-shaped lower brace member 65. These brace members 64 and 65 serve as a strength member for improving a coupling strength between the vehicle body frame 3 and the backhoe support frame 61.

In the embodiment, the leading end side of each of the upper brace members 64 is fastened by bolts to a first bracket 66 welded and fixed to an outer side surface of the rear portion of the corresponding main frame 4. The base end side of each of the upper brace members 64 is fastened by bolts to a coupling bracket 67 fastened by bolts to an upper portion side of the corresponding right and left side frame portion 63. A leading end side of each of the lower brace members 65 is fastened by bolts to a second bracket 68 fastened by bolts to further forwardly than the first bracket 66 in the outer side surface of the rear portion of the corresponding main frame 4. A base end side of each of the lower brace members 65 is fastened by bolts to a lower end portion of the corresponding right and left side frame portion 63.

An approximately flat plate-shaped reinforcing plate 70 extending laterally is arranged between both the right and left lower brace members 65. Right and left end portions of the reinforcing plate 70 serves as a stepped portion 71 formed as a step shaped in a front view, and the stepped portion 71 is fastened by bolts to the corresponding lower brace member 65 (two positioned per each of right and left sides, totally four positions). Accordingly, the reinforcing plate 70 serves as a strength member for improving a coupling strength between both the lower brace members 65 and between the vehicle body frame 3 and the backhoe support frame 61. A leading end side of the stepped portion 71 serves as a protruding end portion 72 protruding to rightwardly and leftwardly relative to each of the lower brace members 65. On the other hand, a support bracket 73 protruding to right and left outer sides is welded and fixed to a lower position than the first bracket 66 in the outer side surface of the rear portion of each of the main frames 4.

As shown in FIGS. 7 and 8, the transmission case 21 comes close to the backhoe support frame 61 while being positioned between the right and left main frames 4. A lower surface of the transmission case 21 is supported by a base portion of the reinforcing plate 70. Each of the rear axle cases 22 protruding to the right and left outer sides from the transmission case 21 is inserted between the main frame 4 and the lower brace member 65.

Each of the support brackets 73 and the protruding end portion 72 of the right and left stepped portion 71 in the reinforcing plate 70 are so coupled that the rear axle case 22 is disposed therebetween from the upper end lower sides. In this case, as shown FIG. 7, three elements including each of the support brackets 73, the right and left protruding end portion of the reinforcing plate 70, and the rear axle case 22 are fastened in common by a headed continuous threaded bolt 74 screwed from the upper side (at two positions per each of right and left sides, totally four positions), and it is possible to finely adjust the attaching position of the transmission case 21 and the right and left rear axle case 22 with respect to the reinforcing plate 70, on the basis of a screwing operation of each of the continuous threaded bolts 74.

In the embodiment, the transmission case 21 and the rear axle case 22 are made of an aluminum die casting, and its Young's modulus is about 130 GPa. The vehicle body frame 3, the backhoe support frame 61, each of the brace members 64 and 65, and each of the support brackets 73 are made of a structural rolled steel, and its Young's modulus is about 210 GPa. Further, the reinforcing plate 70 is made of a cast iron, and its Young's modulus is about 100 GPa.

In accordance with the structure mentioned above, since each of the support brackets 73 and the protruding end portion 72 of the right and left stepped portion 71 in the reinforcing plate 70 are so coupled that the rear axle case 22 is disposed therebetween from the upper and lower sides, the reinforcing plate 70 and both the right and left lower brace members 65 serve as the strength member supplementing the rigidity of the vehicle body frame 3, and the load generated at a time of traveling in a state in which the backhoe 41 is installed and at a time of an evacuating work by the backhoe 41 is dispersed to the reinforcing plate 70 and both the right and left lower brace members 65 in addition to the vehicle body frame 3 and the backhoe support frame 61.

Accordingly, since it is possible to improve the support strength as a whole of the traveling vehicle body 2 with respect to the transmission case 21 and the rear axle case 22, and it is possible to inhibit the load from being propagated to the cases 21 and 22, it is not necessary to thicken the cases 21 and 22 themselves, and it is possible to avoid an increase in size of the cases. As a result, it is possible to contribute to suppression of the manufacturing cost.

Particularly, in the embodiment, since three elements including each of the support brackets 73, the right and left protruding end portion of the reinforcing plate 70, and the rear axle case 22 are fastened in common by the headed continuous threaded bolt 74 screwed from the upper side (at two positions per each of right and left sides, totally four positions), and it is possible to finely adjust the attaching position of the transmission case 21 and the right and left rear axle case 22 with respect to the reinforcing plate 70 in accordance with the screwing operation of each of the continuous threaded bolt 74, it is easy to bring the reinforcing plate 70 into close contact with the lower surface of the transmission case 21, and it is possible to further improve the support strength with respect to the transmission case 21 and the rear axle case 22.

Further, since the reinforcing plate 70 most closely attached to the transmission case 21 is made of a raw material having the smallest Young's modulus, the load generated at a time of traveling in the state in which the backhoe 41 is installed and at a time of the excavating work by the backhoe 41 tends to be concentrated on the reinforcing plate 70. Accordingly, it is possible to effectively inhibit the load from being propagated to the transmission case 21 and the rear axle case 22.

In this case, as shown in FIG. 8, a working fluid feed coupler 76 and a working fluid return coupler 77 are installed as a hydraulic piping coupler to a coupler bracket 75 provided in an inner peripheral side of the upper frame portion 62 in the backhoe support frame 61.

Although not being illustrated in detail, each of both the couplers 76 and 77 is connected to the transmission case 21 serving as a working fluid tank via a hydraulic piping. Each of the couplers 76 and 77 is structured such as to be connectable to the hydraulic piping coupler existing in the base plate side of the backhoe 41, and is structured such that the working fluid within the transmission case 21 is fed to and discharged from the various cylinders 49 to 53 for actuating the backhoe 41, via each of the couplers 76 and 77.

Further, an electric wiring coupler 78 is also installed to the coupler bracket 75 of the upper frame portion 62 in the backhoe support frame 61, and can be connected to an electric piping coupler (not shown) existing in the base plate side of the backhoe 41. In accordance with this structure, in addition to the hydraulic couplers 76 and 77, since the electrical coupler 78 is arranged collectively in the coupler bracket 75 of the upper frame portion 62 in the backhoe support frame 61, it is easy to carry out an attaching and detaching work of the various couplers 75 to 77. In addition, since the coupler bracket 75 is provided in the upper frame portion 62 of the backhoe support frame 61, it is possible to contribute to an improvement of an attaching and detaching workability of the couplers 76 and 78 in this point.

In this case, the support structure of the control seat 16 in the embodiment is as follows. As shown in FIGS. 7 and 9, an attaching seat 91 of an approximately box shape in a plan view is provided in the upper surface of the transmission case 21. A front portion of the attaching seat 91 is fastened by bolts to the upper surface of the transmission case via a C-shaped arm 93, and a rear portion of the attaching seat 91 is fastened by bolts to the upper surface side of the upper frame portion 62 in the backhoe support frame 61.

An upper surface of the attaching seat 91 is provided with a seat bracket 94 supporting the control seat 16 so as to be horizontally rotatable. The seat bracket 94 is provided with a bottom support plate 95 mounted on the attaching seat 91 so as to be horizontally rotatable, and a top slide plate 96 mounted on the bottom support plate 95 so as to be slidable longitudinally, and the seat surface of the control seat 16 is fixed to the top slide plate 96.

A boss tube portion 97 penetrating up and down is fixed to a center portion of the bottom support plate 95, and the seat bracket 94 and the control seat 16 can be rotated horizontally by rotatably inserting the boss tube portion 97 to an upward and downward penetrating insertion tube portion 92 provided in the attaching seat 91 (a forward and backward orientation of the control seat 16 can be changed). Further, a forward and backward position of the control seat 16 can be adjusted on the basis of a forward and backward slide of the top slide plate 96.

A seat elevating cylinder 98 for moving up and down the seat bracket 94 and the control seat 16 is provided in a lower side of the attaching seat 91 in the upper surface of the transmission case 21. The seat elevating cylinder 98 is inserted into the boss tube portion 97 of the bottom support plate 95, and a cylinder portion **98*a* thereof is fastened with a pin to an upper end of the boss tube 97 (see FIG. 12). A piston rod 98*b* of the seat elevating cylinder 98 is coupled to an arm 99 provided in a protruding manner in the upper surface of the transmission case 21. Accordingly, since the boss tube portion 97 of the seat support plate 95 is moves so as to rise and set with respect to the insertion tube portion 92 of the attaching seat 91 in accordance with an expanding and contracting motion of the piston rod 99 in the seat elevating cylinder 98, it is possible to regulate an elevating position of the seat bracket 94 and the control seat 16**.

A front face side of the attaching seat 91 is provided with a sliding type height regulating lever 100 which can be fitted to and detached from the boss tube portion 97 of the insertion tube portion 92 and the bottom support plate 95. The height regulating lever 100 is structured such as to be operable so as to slide forward and backward, and the elevating position of the seat bracket 94 and the control seat 16 can be regulated stepwisely by fitting and detaching the leading end portion thereof to and from a plurality of engagement holes 101 formed in the boss tube portion 97, in accordance with the forward and backward sliding operation of the height regulating lever 100. The height regulating lever 100 is always energized to a rear side (a direction in which the engagement hole 101 is fitted) by a compression spring 102 fitted to an end portion in the insertion tube portion side.

In the case that the control seat 16 is rotated at 180 degree so as to be directed backward, the engagement of the boss tube portion 97 in the seat support plate 95 with the engagement hole 101 is canceled by pulling the height regulating lever 100 to a near side, the seat elevating cylinder 98 is temporarily elongated, and the control seat 16 is thereafter rotated at 180 degree per the seat bracket 94 so as to be directed backward. Thereafter, the operator seats on the control seat 16, whereby the leading end portion of the height regulating lever 100 is fitted to the engagement hole 101 of the boss tube portion 97 in the seat support plate 95 on the basis of an energizing force of the compression spring 102, and the elevating position of the seat bracket 94 and the control seat 16 is fixed.

In this case, the control seat 16 may be structured such as to be moved up and down while being horizontally rotated so as to be changed in the forward and backward orientation. For example, the boss tube portion 97 of the bottom support plate 95 and the insertion tube portion 92 of the attaching seat 91 may be coupled in a screwing manner.

(3) Structure of Safety Mechanism

Next, a description will be given of a structure of a safety mechanism 80 for preventing a careless drive of the TLB 1 with reference to FIG. 13.

The safety mechanism 80 of the TLB 1 in the embodiment is provided with a battery 81, a key switch 82 for applying a power supply, and an engine stop solenoid 83 serving as an engine stop mechanism provided in association with a fuel injection pump with governor (not shown) regulating a fuel injection amount to the engine 8.

The key switch 82 in the embodiment is a rotary type switch which can switch three terminal positions including an off terminal 82*a*, an on terminal 82*b* and a starter terminal 82*c* in accordance with a rotating operation, and the engine stop solenoid 83 is connected in series to the on terminal 82*b* of the key switch 82 via a seating sensor 84 serving as a seating detecting means detecting a seating of the operator on the control seat 16, and a direction detecting sensor 85 serving as a seat direction detecting means detecting the direction of the control seat 16. The fuel feed from the fuel tank (not shown) to the engine 8 is cancelled by an operation of the engine stop solenoid 83. As a result, the drive of the engine 8 is stopped.

The seating sensor 84 is of an on-off changeover switch type which is activated to be turned off if the operator separates from the control seat 16. The direction detecting sensor 85 is of an on-off changeover switch type which is activated to be turned off if the control seat 16 is rotated at 180 degree so as to be directed backward.

In the case that the operator does not seat on the forward-looking control seat 16, the seating sensor 84 and the direction detecting sensor 85 come to an on state, the engine stop solenoid 83 is activated, and the drive of the engine 8 is automatically stopped. Accordingly, the drive of the TLB 1 is inhibited during a period that the operator does not seat on the forward-looking control seat 16.

On the other hand, in the case that the control seat 16 is rotated at 180 degree so as to be directed backward, the direction detecting sensor 85 is the off state regardless of the on and off of the seating sensor 84. Accordingly, a current application to the engine stop solenoid 83 is kept being shut off. Therefore, if the control seat 16 is directed backward, the engine stop solenoid 83 can not be activated regardless of that whether or not the operator seats and the engine 8 maintains the drive state. Accordingly, it is possible to smoothly carry out the engine start at a time of the excavating work of the backhoe 41 which is carried out by setting the control seat 16 backward, in spite of the TLB 1 which has the seating sensor 84 and taking the safety into consideration.

The starter terminal 82*c* of the key switch 82 is connected in series to a starter 88 for starting the engine 7 via a PTO sensor 86 and a parking sensor 87. The PTO sensor 86 is of an on-off changeover switch type which is activated to be turned on by turning off the PTO lever 17 serving as the PTO operating means operating so as to maintain and interrupt the power transmission to the mower device 25. The parking sensor 87 is of an on-off changeover switch type which is activated to be turned on by turning on the parking brake lever 14 serving as the parking brake operating means carrying out the operation for maintaining the braked state of both the right and left wheels 7.

If the key switch 82 is turned to a position of the starter terminal 82C in the case that the parking brake lever 14 is in the on state (under the braking operation), and the PTO lever 17 is in the off state, the starter 88 is activated on the basis of the power feed from the battery 81 because the PTO sensor 86 and the parking sensor 87 are in the on state, so that the engine 8 is started. If at least one of the PTO sensor 86 and the parking sensor 87 is the off state, the current application to the starter 88 is kept being shut off, and the engine 8 is not started. Accordingly, it is possible to prevent the mower device 25 from being carelessly driven at a time of starting the engine 8, and it is possible to securely prevent a risk that the TLB 1 rapidly starts.

In this case, it is possible to employ a structure for invalidating a pedaling operation of the shift pedal 12 by automatically turning on the parking brake mechanism retaining the braked state of both the right and left wheels 7 on the basis of the on operation of the parking brake lever 14 in accordance with the driving of an actuator such as an electric motor or the like, in a case that the operator is seated on the backward-looking control seat 16, or canceling the coupling of the operating force transmission system between the transmission case 21 and the shift pedal 12 in the case, the structure not being illustrated in detail. Further, it is possible to employ a structure for automatically turning off the PTO clutch maintaining and interrupting the power transmission from the transmission case 21 to the mower device 25 on the basis of the driving of the actuator such as the electric motor or the like, in the case that the operator seats on the backward-looking control seat 16. Both of them take into consideration of the safety at a time of the excavating work by the backhoe 41.

(4) Other

The present invention is not limited to the embodiment mentioned above, but can be embodied into various aspects. For example, the present invention is not limited to the TLB, but can be applied to a tractor which does not have the front loader but is provided only with the backhoe. In addition, the structure of each of the portions is not limited to the illustrated embodiment, but can be variously modified within the scope of the present invention.

What is claimed is:

1. A working vehicle comprising:

a vehicle body frame including a pair of right and left main frames which extend longitudinally and a plurality of horizontal frames which extend laterally in a ladder shape;

a backhoe support frame provided in a rear end portion of the vehicle body frame;

a pair of right and left upper brace members connecting an upper portion side of each of the main frames and an upper portion side of the backhoe support frame;

a pair of right and left lower brace members connecting a lower portion side of each of the main frames and a lower portion side of the backhoe support frame;

a pair of right and left support brackets provided in an outer side surface of a rear portion of each of the main frames so as to protrude outward; and a reinforcing plate attached to both of the lower brace members and supporting a lower surface of a transmission case mounted on a rear portion side of the vehicle body frame, wherein each of the support brackets, and a protruding end portion protruding to the rightwardly and leftwardly relative to each of the lower brace members in the reinforcing plate are so coupled that a rear axle case protruding outward from the right and left outer side surfaces of the transmission case is disposed between the support bracket and the protruding end portion from upper and lower sides.

2. The working vehicle according to claim 1, wherein three elements including each of the support brackets, the right and left end portion of the reinforcing plate and the rear axle case are fastened in common by a headed continuous threaded bolt, and an attaching position of the transmission case and the right and left rear axle case with respect to the reinforcing plate is finely adjustable on the basis of a screwing operation of the continuous threaded bolts.

3. The working vehicle according to claim 1, wherein the transmission case and the rear axle case are made of an aluminum die casting, the vehicle body frame, the backhoe support frame, each of the brace members and each of the support brackets are made of a structural rolled steel, and the reinforcing plate is made of a cast iron.

4. The working vehicle according to claim 1, wherein the backhoe support frame is formed in a rectangular shape in a front view, and a hydraulic piping coupler and an electric wiring coupler are installed to a coupler bracket provided in an upper frame portion thereof.

* * * * *